US009230434B2

(12) United States Patent
Imai et al.

(10) Patent No.: US 9,230,434 B2
(45) Date of Patent: Jan. 5, 2016

(54) ROAD TRAFFIC INFORMATION SERVER AND ROAD TRAFFIC INFORMATION SYSTEM

(71) Applicant: HONDA MOTOR CO., LTD., Tokyo (JP)

(72) Inventors: Takeshi Imai, Tokyo (JP); Yoshiaki Hirai, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/384,944

(22) PCT Filed: Apr. 30, 2013

(86) PCT No.: PCT/JP2013/062565

§ 371 (c)(1),
(2) Date: Sep. 12, 2014

(87) PCT Pub. No.: WO2013/190916

PCT Pub. Date: Dec. 27, 2013

(65) Prior Publication Data

US 2015/0029043 A1 Jan. 29, 2015

(30) Foreign Application Priority Data

Jun. 19, 2012 (JP) ..... 2012-137946

(51) Int. Cl.
*G08G 1/065* (2006.01)
*G08G 1/01* (2006.01)

(52) U.S. Cl.
CPC ..... *G08G 1/0133* (2013.01); *G08G 1/0112* (2013.01)

(58) Field of Classification Search
CPC ..... G08G 1/0133; G08G 1/0112
USPC ..... 340/933, 934, 936; 701/118, 117, 119, 701/400, 414
See application file for complete search history.

(56) References Cited

U.S. PATENT DOCUMENTS 8,433,504 B2 * 4/2013 Hayashida ..... G01C 21/26 340/917
8,914,226 B2 * 12/2014 Miyajima ..... G08G 1/0112 340/933

(Continued)

FOREIGN PATENT DOCUMENTS

JP 2003-281674 A 10/2003
JP 2005-165388 A 6/2005

(Continued)

OTHER PUBLICATIONS

International Search Report dated Jul. 9, 2013 corresponding to International Patent Application No. PCT/JP2013/062565 and English translation thereof.

(Continued)

*Primary Examiner* — Eric Blount
(74) *Attorney, Agent, or Firm* — Squire Patton Boggs (US) LLP

(57) ABSTRACT

Provided are a server and a system that are capable of generating road traffic information on traffic congestion in a more appropriate manner, considering actual road traffic conditions. If a vehicle speed V falls below a first reference speed $V_1$ and then exceeds a second reference speed $V_2$ ($>V_1$), then a traffic congestion situation is estimated based on an inference that the vehicle is highly likely to have escaped from traffic congestion. To estimate a traffic congestion situation, it is required that a situation in which the vehicle speed V exceeds the second reference speed $V_2$ continue for a second specified distance or more or for a second specified time $T_2$ or more.

2 Claims, 4 Drawing Sheets

(56) References Cited

U.S. PATENT DOCUMENTS

| | | | | |
|---|---|---|---|---|
| 9,135,624 | B2 * | 9/2015 | Basir | G06Q 20/4016 |
| 2010/0121522 | A1 * | 5/2010 | Wolfson | G01S 5/0027 701/31.4 |
| 2011/0313740 | A1 * | 12/2011 | Ikeda | G05B 17/02 703/2 |
| 2011/0320111 | A1 * | 12/2011 | Sarma | G08G 1/0104 701/118 |
| 2012/0083995 | A1 * | 4/2012 | Vorona | G08G 1/0104 701/119 |

FOREIGN PATENT DOCUMENTS

| | | | |
|---|---|---|---|
| JP | 2006-059058 | A | 3/2006 |
| JP | 2011-238144 | A | 11/2011 |

OTHER PUBLICATIONS

Japanese International Preliminary Report on Patentability application No. PCT/JP2013/062565 dated Oct. 21, 2014.

* cited by examiner

| ROUTE | INBOUND/ OUTBOUND | CURRENT TRAFFIC CONGESTION SITUATION | | | | |
|---|---|---|---|---|---|---|
| | | TRAFFIC CONGESTION SECTION | TRAFFIC CONGESTION LENGTH | KP | REQUIRED TIME | INFORMATION ACQUISITION TIME |
| ROUTE XX | INBOUND | ○~○ | ○km | ○○KP→○○KP | ○MIN | ○○:○○ |
| | | | | | | |

⋮

ROAD TRAFFIC INFORMATION SERVER AND ROAD TRAFFIC INFORMATION SYSTEM

TECHNICAL FIELD

The present invention relates to a technology for generating road traffic information based on probe information which is collected from a vehicle and which includes the time-series positions of the vehicle.

BACKGROUND ART

There has been proposed a technical method for generating road traffic information based on probe information. According to the method, if a state in which the speed of a vehicle is equal to or lower than a predetermined value (e.g. 20 km/h) continues, then the road traffic information that includes the positions of the vehicle at the start time point and the end time point, respectively, or the distance of the section is generated (refer to Patent Literature 1).

CITATION LIST

Patent Literature

Patent Literature 1: Japanese Patent Publication Laid-open No. 2003-281674

SUMMARY OF INVENTION

Technical Problem

However, there is a possibility that the estimated results of traffic congestion situations, such as traffic congestion lengths, depart from actual road traffic conditions because, for example, when the speed of a vehicle increases from a predetermined value or less until it exceeds the predetermined value, the time required for the speed of the vehicle to go back down to the predetermined value or less is short. This may cause emotional stress to a driver who is driving the vehicle according to the road traffic information that includes the estimated results as an indicator.

Accordingly, an object of the present invention is to provide a server and a system that are capable of generating road traffic information on traffic congestion in a more appropriate manner, considering actual road traffic conditions.

Solution to Problem

The present invention relates to a road traffic information server configured to sequentially generate road traffic information based on probe information which includes time-series positions of a vehicle sequentially collected from the vehicle, and a road traffic information system constituted of the road traffic information server and a road traffic information client installed in a vehicle.

A road traffic information server in accordance with the present invention includes: a first server arithmetic processing element configured to estimate a traffic congestion situation based on time-series positions of a vehicle determined from probe information in a period from a time point at which a speed of the vehicle determined from the probe information falls below a first reference speed to a time point at which the speed of the vehicle exceeds a second reference speed, which is higher than the first reference speed; and a second server arithmetic processing element configured to generate the road traffic information based on the traffic congestion situation estimated by the first server arithmetic processing element.

In a road traffic information system in accordance with the present invention, the road traffic information client includes: a first client arithmetic processing element configured to sequentially measure the position of the vehicle and transmit the probe information including the time-series measured positions of the vehicle to the road traffic information server; and a second client arithmetic processing element configured to receive one or both of the traffic congestion situation and the road traffic information from the road traffic information server and output one or both of the traffic congestion situation and the road traffic information in a form that is recognizable to an occupant of the vehicle.

Further, in the road traffic information server and a road traffic information system having the road traffic information server as a constituent element thereof, the first server arithmetic processing element estimates the traffic congestion situation based on the time-series positions of the vehicle during the period from the time point at which the speed of the vehicle falls below the first reference speed to a time point at which the speed of the vehicle exceeds the second reference speed most recently on condition that a situation in which the speed of the vehicle exceeds the second reference speed continues for a specified distance or more or for a specified time or more.

In addition, the first server arithmetic processing element is configured to set the specified distance or the specified time longer as a number of times the speed of the vehicle exceeds the second reference speed from the time point at which the speed of the vehicle falls below the first reference speed, increases.

According to the road traffic information server and the road traffic information system having the road traffic information server as a constituent element thereof, if a vehicle speed falls below the first reference speed and then exceeds the second reference speed, which is higher than the first reference speed, a traffic congestion section is estimated based on an inference that the vehicle is highly likely to have escaped from traffic congestion. This, in other words, makes it possible to prevent an erroneous assumption that the vehicle has escaped from the traffic congestion when the vehicle speed falls below the first reference speed and then exceeds the first reference speed with a slow increase in the speed thereafter, indicating a high possibility of the vehicle being still caught in the traffic congestion.

Thus, the possibility or degree of discrepancy of a traffic congestion situation from actual road traffic conditions, such as a traffic congestion section estimated to be unduly short, can be reduced. As a result, road traffic information on traffic congestion can be generated in a more appropriate manner, considering actual road traffic conditions.

Further, the road traffic information server and system configured as described above make it possible to prevent an erroneous assumption that the vehicle has escaped from traffic congestion when the vehicle speed falls below the first reference speed and then exceeds the second reference speed but soon falls to the second reference speed or lower, indicating a high possibility that the vehicle is still caught in the traffic congestion. Thus, the possibility or degree of discrepancy of a traffic congestion situation from actual road traffic conditions, such as a traffic congestion section estimated to be unduly short, can be further reduced. As a result, road traffic information on traffic congestion can be generated in a more appropriate manner, considering actual road traffic conditions.

Further, according to the road traffic information server and the system configured as described above, if a situation in which it cannot be assumed that a vehicle has escaped from traffic congestion continues for a long distance or a long time, then it is regarded that the requirement for the assumption is difficult to satisfy, thus reducing the possibility of a traffic congestion section being estimated to be unduly short in view of an actual traffic congestion situation. As a result, road traffic information on traffic congestion can be generated in a more appropriate manner, considering actual road traffic conditions.

DESCRIPTION OF EMBODIMENTS (Configuration)

Figure 1:
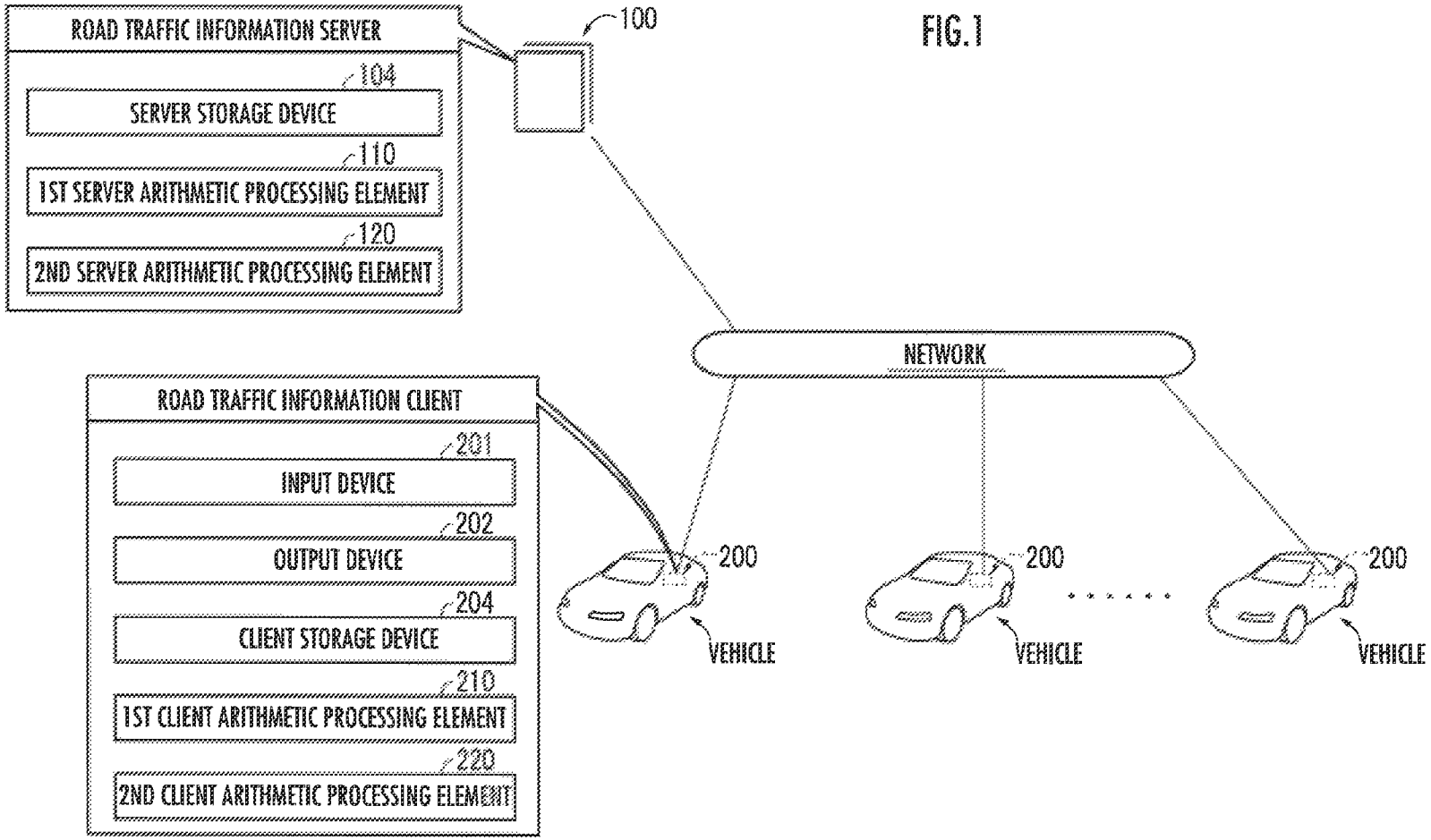
FIG. 1 is a configuration diagram of a road traffic information system as an embodiment of the present invention.

A road traffic information system illustrated in FIG. 1 is constituted of a road traffic information server 100 and road traffic information clients 200. Among a plurality of the road traffic information clients 200, at least some road traffic information clients 200 may function as the road traffic information server 100 either temporarily or permanently.

The road traffic information server 100 has a server storage device 104, a first server arithmetic processing element 110, and a second server arithmetic processing element 120. The road traffic information server 100 has a function to communicate with the road traffic information clients 200 through a network and is constituted of a single or a plurality of server computers. As the communication network, a communication network or the like that uses the Internet, a telephone line network, satellite broadcasting or the like may be used.

The server storage device 104 is adapted to store a server map in which each point is described in terms of latitude and longitude. According to the server map, a link connecting two separate points (e.g. an intersection) is described by a group of coordinate values or a string of coordinates that indicates a plurality of points on the link. At least some links may be described by being associated with, for example, link identification information for identifying the links or the types of roads formed of the links. Further, the ranges in which parks, rivers, the sites of facilities, and the like are located are described by the outlines of the ranges or the string of coordinates indicating a plurality of points on a closed curve. Alternatively, each range may be described by being associated with the types of objects located in the range.

Figure 3A:
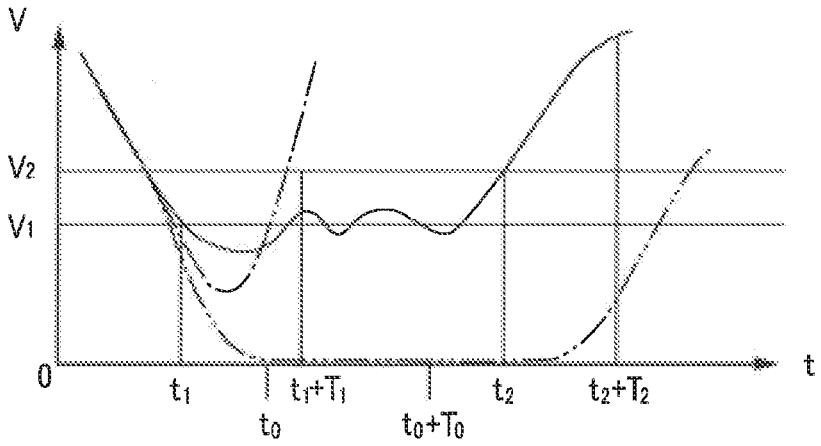
FIG. 3A and FIG. 3B are explanatory diagrams related to a method for estimating a traffic congestion situation.
Figure 3B:
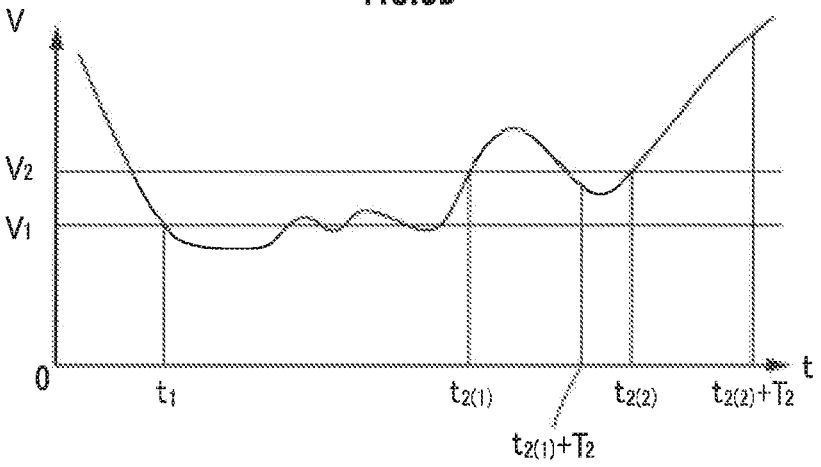

The first server arithmetic processing element 110 is adapted to estimate a traffic congestion situation, such as a traffic congestion section, based on the time-series positions of a vehicle determined from probe information during the period from a time point $t=t_1$ at which the speed of the vehicle determined from probe information falls below a first reference speed $V_1$ to a time point $t_2$ at which the speed of the vehicle exceeds a second reference speed $V_2$, which is higher than the first reference speed $V_1$ (refer to FIG. 3A and FIG. 3B). The second server arithmetic processing element 120 is adapted to generate road traffic information based on the traffic congestion situation estimated by the first server arithmetic processing element 110.

Each of the first server arithmetic processing element 110 and the second server arithmetic processing element 120 is comprised of a programmable computer. The constituent elements of the present invention being configured to carry out information arithmetic processing for which they are responsible means that the constituent elements are programmed to read programs from a memory and carry out the information arithmetic processing for which they are responsible according to the programs. The programs are downloaded through a network or installed through a storage medium to the road traffic information server 100. Each of the first server arithmetic processing element 110 and the second server arithmetic processing element 120 may be partly or entirely constituted of physically independent separate hardware.

Each of the road traffic information clients 200 includes an input device 201, an output device 202, a client storage device 204, a first client arithmetic processing element 210, and a second client arithmetic processing element 220. Each of the road traffic information clients 200 is configured as equipment to be permanently or temporarily installed in a vehicle. The road traffic information client 200 may be formed of portable equipment.

The input device 201 is comprised of a push-button type or a touch-panel type interface, which enables a user to input information, such as entering a specified destination point. The input device 201 may alternatively be comprised of a microphone and a voice recognition device that analyzes acoustic signals collected through the microphone to recognize the contents of a speech of the user or information intended to be input.

The output device 202 is comprised of an image output device formed of a liquid crystal panel or the like on which a client map and the like are displayed. In the case where the input device 201 is composed of a touch-panel type interface, the image output device displays touch buttons. The output device 202 may be comprised of, in addition to the image output device, an audio output device that outputs voice signals associated with image information displayed on the image output device.

The client storage device 204 is adapted to store a client map in which each point is described by latitude and longitude. According to the client map, a link connecting two separate points is described by a group of coordinate values or a string of coordinates that indicates a plurality of points on the link. At least some links may be described by being associated with, for example, link identification information for identifying the links or the types of roads formed of the links. Further, the ranges in which parks, rivers, the sites of facilities, and the like are located are described by the outlines of the ranges or the string of coordinates indicating a plurality of points on a closed curve. Alternatively, each range may be described by being associated with the types of objects located in the range.

The client map may be a map that is the same as the server map or may be a map that is different from the server map at least partly in format.

The first client arithmetic processing element 210 is adapted to sequentially measure the position of a vehicle and transmit probe information, including the time-series measured positions of the vehicle, to the road traffic information server 100. The second client arithmetic processing element 220 is configured to receive one or both of a traffic congestion situation and road traffic information from the road traffic information server 100 and output the information through the output device 202.

Each of the first client arithmetic processing element 210 and the second client arithmetic processing element 220 is comprised of a programmable computer. The programs are downloaded through a network or installed through a storage medium to the road traffic information client 200. Each of the first client arithmetic processing element 210 and the second client arithmetic processing element 220 may be partly or entirely constituted of physically independent separate hardware.

(Function)

The function of the road traffic information system having the configuration described above will be described.

The first server arithmetic processing element 110 receives probe information from the road traffic information client 200 installed in each vehicle. Based on the probe information, a position P ((latitude and longitude) or (latitude, longitude and altitude)) of the vehicle and a speed V at each time point are identified. FIG. 3A and FIG. 3B illustrate temporal change patterns of the vehicle speed V by solid lines, a dashed-dotted line or a two-dot chain line. The road (e.g. the name and the type thereof) on which the vehicle is traveling and the traveling direction are identified based on the time-series positions of the vehicle indicated by the probe information and by referring to the server map information.

The first server arithmetic processing element 110 carries out arithmetic processing for estimating the traffic congestion situation according to the procedure described below.

First, it is determined whether the vehicle speed V has fallen below the first reference speed $V_1$ after the state in which the vehicle speed V is higher than the second reference speed $V_2$ continued for a specified distance or longer or for a specified time $T_2$ or longer (STEP02 of FIG. 2). If the determination result is affirmative (YES in STEP02 of FIG. 2; refer to $t=t_1$ in FIG. 3A), then three timer count values $\Sigma_0$, $\Sigma_1$ and $\Sigma_2$ are set or reset to zero (STEP04 of FIG. 2).

The timer count value $\Sigma_0$ corresponds to the time during which a state wherein the vehicle speed V is maintained at zero or a value in the vicinity thereof (e.g. a value equivalent to or less than 5 km/h) continues. The timer count value $\Sigma_1$ corresponds to the time during which a state wherein the vehicle speed V is below the first reference speed $V_1$ continues. The timer count value $\Sigma_2$ corresponds to the time during which a state wherein the vehicle speed V exceeds the second reference speed $V_2$ continues. Thereafter, the arithmetic processing described below is carried out for each arithmetic processing cycle $\Delta t$ based on the vehicle speed V identified according to latest probe information.

Figure 2:
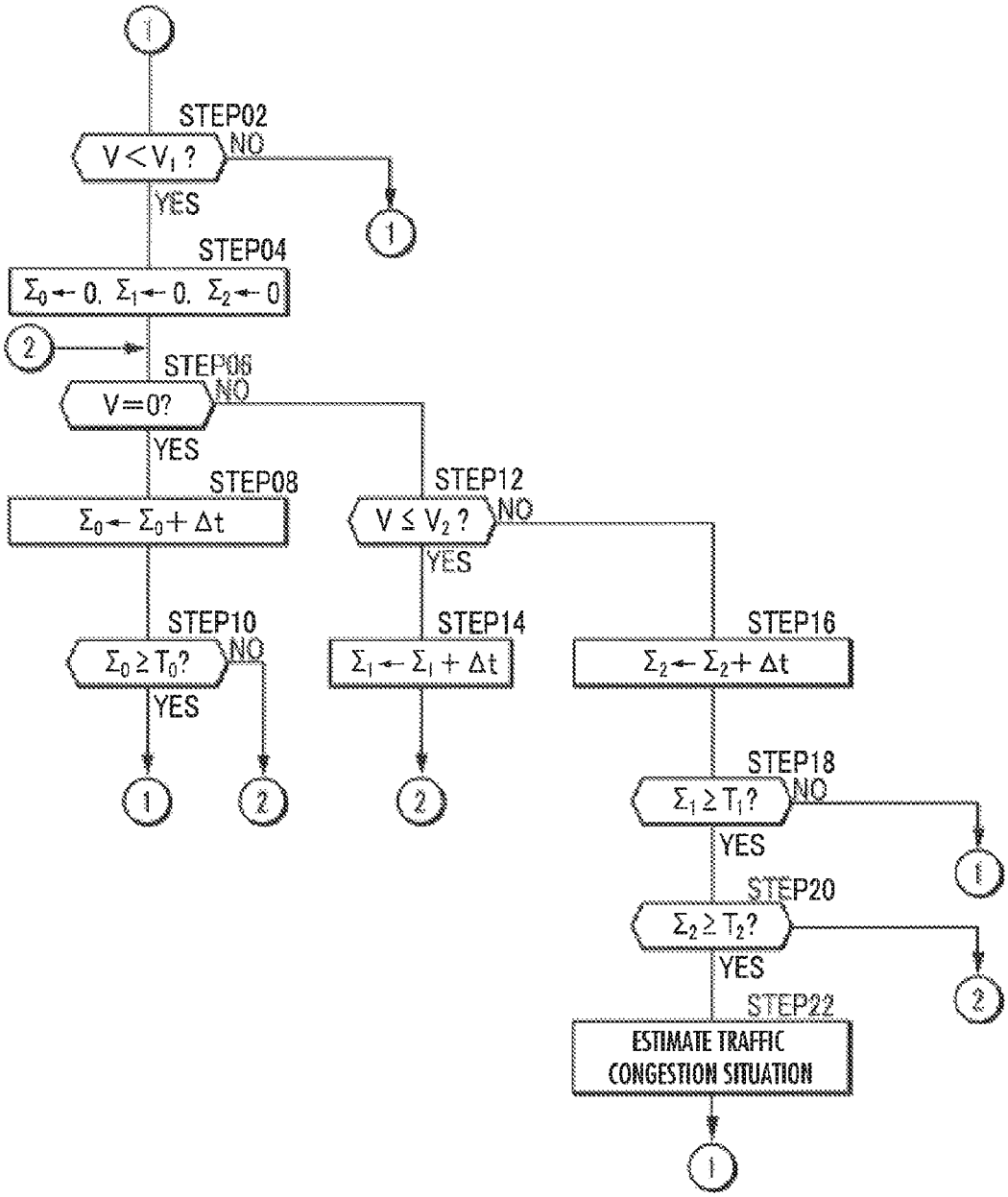
FIG. 2 is a functional explanatory diagram of the road traffic information system.

It is determined whether the vehicle speed V is zero or a value in the vicinity thereof (STEP06 of FIG. 2). If it is determined that the vehicle speed V is zero or a value in the vicinity thereof (YES in STEP06 of FIG. 2; refer to $t=t_0$ in FIG. 3A), then the timer counter value $\Sigma_0$ is incremented by $\Delta t$ (STEP08 of FIG. 2). Then, it is determined whether the timer counter value $\Sigma_0$ is below a stop determination time $T_0$ (STEP10 of FIG. 2).

If the timer counter value $\Sigma_0$ is equal to or more than the stop determination time $T_0$ (YES in STEP10 of FIG. 2), then the probe information of the vehicle is excluded from an estimation basis of the traffic congestion situation. For example, as indicated by the two-dot chain line in FIG. 3A, if the vehicle speed V falls to zero at a time point $t=t_0$ after having fallen below the first reference speed $V_1$ at $t=t_1$ and this state continues for the stop determination time $T_0$ or longer, then the probe information of the vehicle is excluded from the estimation basis of the traffic congestion situation. This makes it possible to avoid generating a traffic congestion situation according to the probe information of a vehicle that is highly likely to be at a stop simply because an occupant is taking a break or taking care of some business irrelevantly to the presence or the degree of traffic congestion.

If the timer counter value $\Sigma_0$ is below the stop determination time $T_0$ (NO in STEP10 of FIG. 2), then the arithmetic processing after the comparison between the vehicle speed V and zero or a value in the vicinity thereof (refer to STEP06 of FIG. 2) is carried out.

If it is determined that the vehicle speed V is a positive value or exceeds a value in the vicinity of zero (NO in STEP06 of FIG. 2), then it is determined whether the vehicle speed V is equal to or less than the second reference speed $V_2$ (STEP12 of FIG. 2). If it is determined that the vehicle speed V is equal to or less than the second reference speed $V_2$ (YES in STEP12 of FIG. 2), then the timer counter value $\Sigma_1$ is incremented by $\Delta t$ (STEP 14 of FIG. 2), and the arithmetic processing after the comparison between the vehicle speed V and zero or a value in the vicinity thereof (refer to STEP06 of FIG. 2) is carried out.

If it is determined that the vehicle speed V exceeds the second reference speed $V_2$ (NO in STEP12 of FIG. 2), then the timer counter value $\Sigma_2$ is incremented by $\Delta t$ (STEP16 of FIG. 2) and it is determined whether the timer counter value $\Sigma_1$ is equal to or more than a first specified time $T_1$ (STEP18 of FIG. 2). In addition to or in place of the determination, it may be determined whether the traveling distance of the vehicle in the period during which the state wherein the vehicle speed V has fallen to the second reference speed $V_2$ or less is maintained (refer to YES in STEP12 of FIG. 2) is a first specified distance or more. If the timer counter value $\Sigma_1$ is below the first specified time $T_1$ (NO in STEP18 of FIG. 2), then the probe information of the vehicle is excluded from the estimation basis of the traffic congestion situation. For example, as indicated by the dashed-dotted line in FIG. 3A, in the case where the vehicle speed V falls below the first reference speed $V_1$ at $t=t_1$ and then exceeds the second reference speed $V_2$ before the state in which the vehicle speed V is below the first reference speed $V_1$ continues for the first specified time $T_1$ or longer, the probe information of the vehicle is excluded from the estimation basis of the traffic congestion situation. This makes it possible to avoid generating a traffic congestion situation according to the probe information of a vehicle that is highly likely to have temporarily slowed down irrelevantly to the presence or the degree of traffic congestion.

If the timer counter value $\Sigma_1$ is equal to or more than the first specified time $T_1$ (YES in STEP18 of FIG. 2), then it is determined whether the timer counter value $\Sigma_2$ is equal to or more than a second specified time $T_2$ (corresponding to "a specified time" in the present invention) (STEP20 of FIG. 2). In addition to or in place of the determination, it may be determined whether the traveling distance of the vehicle in a period during which the state wherein the vehicle speed V exceeds the second reference speed $V_2$ is maintained (refer to NO in STEP12 of FIG. 2) is equal to or more than a second specified distance (corresponding to "a specified distance" in the present invention).

If the timer counter value $\Sigma_2$ is below the second specified time $T_2$ (NO in STEP20 of FIG. 2), then the arithmetic processing after the comparison between the vehicle speed V and zero or a value in the vicinity thereof (refer to STEP06 of FIG. 2) is carried out. For example, as indicated by the solid line in FIG. 3B, in the case where the vehicle speed V exceeds the second reference speed $V_2$ at $t=t_{2(1)}$ and then falls to the second reference speed $V_2$ or lower before the state in which the vehicle speed V exceeds the second reference speed $V_2$ continues for a second specified time $T_2$ or more, a traffic congestion situation is not yet estimated.

If the timer counter value $\Sigma_2$ is the second specified time $T_2$ or more (YES in STEP20 of FIG. 2), then the traffic congestion situation is estimated (STEP22 of FIG. 2). For example, as indicated by the solid line in FIG. 3A, if the vehicle speed V exceeds the second reference speed $V_2$ at $t=t_2$ and this state continues for the second specified time $T_2$ or more, then the traffic congestion situation is estimated. Similarly, as indicated by the solid line in FIG. 3B, if the vehicle speed V exceeds the second reference speed $V_2$ at $t=t_{2(2)}$ and this state continues for the second specified time $T_2$ or more, then the traffic congestion situation is estimated.

Figures 4A, 4B:
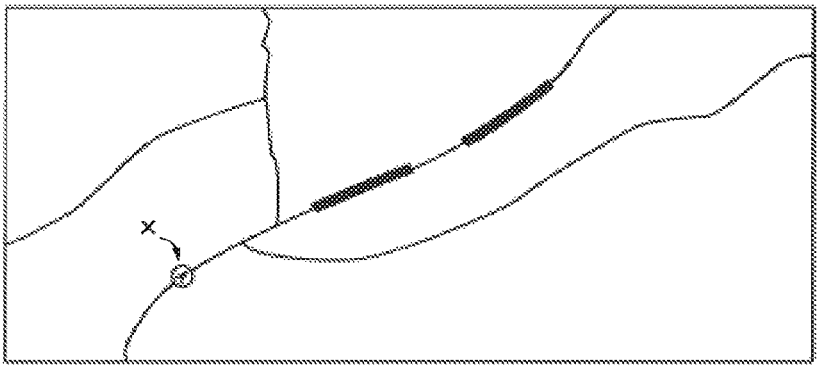
FIG. 4A and FIG. 4B are explanatory diagrams related to a traffic congestion situation and road traffic information.

As illustrated in FIG. 4A, the traffic congestion situation includes, for example, the name of a road having traffic congestion, inbound traffic or outbound traffic of the road (the direction in which a vehicle is traveling), a traffic congestion section (two place names or the name of an interchange), the length of traffic congestion, the kilometer posts (KP) indicating the trailing position and the leading position of a traffic congestion section, the time required to travel in a traffic congestion section, and the time points at which latest probe information that provides the basis for estimating a traffic congestion situation is acquired.

The position of the vehicle at the time point $t=t_1$ at which the vehicle speed V in the estimated traffic congestion situation has fallen below the first reference speed $V_1$ is estimated as the trailing position of the traffic congestion section, and the position of the vehicle at the time point $t=t_2$ at which the vehicle speed V has exceeded the second reference speed $V_2$ is estimated as the leading position of the traffic congestion section (refer to FIG. 3A and FIG. 3B). The interval between the two time points ($t_2$-$t_1$ (refer to FIG. 3A and $t_{2(2)-t1}$ (refer to FIG. 3B)) or the mean value thereof is estimated as the time required for traveling in the traffic congestion section. The traffic congestion length and the like can be estimated based on the trailing position and the leading position of the traffic congestion section and by referring to the server map information (refer to FIG. 4A).

Then, the second server arithmetic processing element 120 transmits the traffic congestion situation estimated by the first server arithmetic processing element 110 to each of the road traffic information clients 200. In each of the road traffic information clients 200, the second client arithmetic processing element 220 receives the traffic congestion situation and causes the output device 202 to output and display the traffic congestion situation.

Thus, the traffic congestion situation illustrated in, for example, FIG. 4A is displayed on a display device constituting the output device 202. In addition, the display device may display a client map in which a traffic congestion section is highlighted in a manner that makes the traffic congestion section distinguishable from remaining sections, as illustrated in FIG. 4B.

(Operational Advantage)

According to the road traffic information server 100 in accordance with the present invention and the road traffic information system having the road traffic information server 100 as a constituent element thereof, if the vehicle speed V exceeds the second reference speed $V_2$ ($>V_1$) after falling below the first reference speed $V_1$, then a traffic congestion section is estimated based on an inference that the vehicle is highly likely to have escaped from traffic congestion (refer to $t=t_2$ in FIG. 3A and $t=t_{2(1)}$, $t_{2(2)}$ in FIG. 3B). To estimate a traffic congestion situation, it is required that the situation in which the vehicle speed V exceeds the second reference speed $V_2$ continues for the second specified time $T_2$ or more.

In other words, it is possible to avoid an erroneous assumption that a vehicle has escaped from traffic congestion, whereas the vehicle is very likely to be still caught in the traffic congestion because the vehicle speed V, although having reached the first reference speed $V_1$ or more after falling below the first reference speed $V_1$, is slow in increasing. It is also possible to avoid an erroneous assumption that the vehicle has escaped from the traffic congestion, whereas the vehicle is very likely to be still caught in the traffic congestion because the vehicle speed V, although having exceeded the second reference speed $V_2$ after falling below the first reference speed $V_1$, has soon fallen to the second reference speed $V_2$ or less.

Thus, the possibility or degree of discrepancy of a traffic congestion situation from actual road traffic conditions, such as a traffic congestion section estimated to be unduly short, is reduced. As a result, road traffic information on traffic congestion can be generated in a more appropriate manner, considering actual road traffic conditions.

(Another Embodiment of the Present Invention)

In the foregoing embodiment, the estimation of a traffic congestion situation requires that the situation in which the vehicle speed V exceeds the second reference speed $V_2$ continue for the second specified time $T_2$ or more (or for the second specified distance or more in place of or in addition thereto). In another embodiment, a traffic congestion situation may be estimated even if the foregoing requirement is not satisfied. More specifically, the resetting and incrementing of the timer count value E and the processing of comparison with the second specified time $T_2$ may be omitted (refer to STEP04, STEP16 and STEP20 of FIG. 2).

The first server arithmetic processing element 110 may be configured to set the second specified time $T_2$ (or the second specified distance in place of or in addition thereto) to be longer as the number of times the vehicle speed V exceeds the second reference speed $V_2$ from the time point $t=t_1$ at which the vehicle speed V fell below the first reference speed $V_1$, increases. For example, if the vehicle speed V changes as illustrated in FIG. 3B, the second specified time $T_2$ at which the vehicle speed V exceeds the second reference speed $V_2$ for the second time at the time point $t=t_{2(2)}$ is set to be longer than the second specified time $T_2$ at which the vehicle speed V exceeds the second reference speed $V_2$ for the first time at the time point $t=t_{2(1)}$.

According to the road traffic information server having the configuration described above, if a situation in which it cannot be assumed that a vehicle has escaped from traffic congestion continues for an extended time, then it is regarded that the requirement for the assumption is difficult to satisfy, thus reducing the possibility of a traffic congestion section being estimated to be unduly short in view of an actual traffic congestion situation. As a result, road traffic information on traffic congestion can be generated in a more appropriate manner, considering actual road traffic conditions.

The second server arithmetic processing element 120 may be configured to generate road traffic information based on the traffic congestion situation in addition to or in place of the traffic congestion situation and to transmit the generated road traffic information to each of the road traffic information clients 200.

For example, the first server arithmetic processing element 110 receives a request to search for a route that includes a departure position (or a current position) of a vehicle and a destination position from (the first client arithmetic processing element 210) of the road traffic information client 200. The second server arithmetic processing element 120 searches for a single or a plurality of server routes that connect the departure position and the destination position according to guidelines for avoiding traffic congestion, time priority or the like by using server map information and traffic congestion situations. Thus, a server route that avoids traffic congestion sections can be preferentially searched.

Further, the second server arithmetic processing element 120 transmits information for identifying the server route (e.g. identifiers commonly used in the server map information and the client map information to identify each of a plurality of links constituting a server route, or the coordinate values of a plurality of discrete positions on the server route) to the road traffic information client 200 that has issued the request for the route search.

In response thereto, the second client arithmetic processing element 220 uses the information and the client map information to reproduce the server route thereby to search for the client route. Then, the second client arithmetic processing element 220 superimposes the client route on the client map and causes the output device 202 to display the client route superimposed on the client map.

DESCRIPTION OF REFERENCE NUMERALS

100 . . . Road traffic information server; 104 . . . Server storage device; 110 . . . First server arithmetic processing element; 120 . . . Second server arithmetic processing element; 200 . . . Road traffic information client; 210 . . . First client arithmetic processing element; and 220 . . . Second client arithmetic processing element.

The invention claimed is:

1. A road traffic information server configured to sequentially generate road traffic information based on probe information which includes time-series positions of a vehicle sequentially collected from the vehicle, comprising:

a first server arithmetic processing element configured to estimate a traffic congestion situation based on time-series positions of the vehicle determined from the probe information in a period from a time point at which a speed of the vehicle determined from the probe information falls below a first reference speed to a time point at which the speed of the vehicle exceeds a second reference speed, which is higher than the first reference speed; and a second server arithmetic processing element configured to generate the road traffic information based on the traffic congestion situation estimated by the first server arithmetic processing element, wherein the first server arithmetic processing element is configured to estimate the traffic congestion situation based on the time-series positions of the vehicle during the period from the time point at which the speed of the vehicle falls below the first reference speed to a time point at which the speed of the vehicle exceeds the second reference speed most recently on condition that a situation in which the speed of the vehicle exceeds the second reference speed continues for a specified distance or more or for a specified time or more, and to set the specified distance or the specified time longer as a number of times the speed of the vehicle exceeds the second reference speed from the time point at which the speed of the vehicle falls below the first reference speed, increases.

2. A road traffic information system comprising: a road traffic information server configured to sequentially generate road traffic information based on probe information which includes time-series positions of a vehicle sequentially collected from the vehicle; and a road traffic information client installed in the vehicle, wherein the road traffic information server comprises:

a first server arithmetic processing element configured to estimate a traffic congestion situation based on time-series positions of the vehicle determined from the probe information in a period from a time point at which a speed of the vehicle determined from the probe information falls below a first reference speed to a time point at which the speed of the vehicle exceeds a second reference speed, which is higher than the first reference speed; and a second server arithmetic processing element configured to generate the road traffic information based on the traffic congestion situation estimated by the first server arithmetic processing element, and the road traffic information client comprises:

a first client arithmetic processing element configured to sequentially measure the position of the vehicle and transmit the probe information including the time-series measured positions of the vehicle to the road traffic information server; and a second client arithmetic processing element configured to receive one or both of the traffic congestion situation and the road traffic information from the road traffic information server and to output one or both of the traffic congestion situation and the road traffic information in a form that is recognizable to an occupant of the vehicle, wherein the first server arithmetic processing element is configured to estimate the traffic congestion situation based on the time-series positions of the vehicle during a period from the time point at which the speed of the vehicle falls below the first reference speed to a time point at which the speed of the vehicle exceeds the second reference speed most recently on condition that a situation in which the speed of the vehicle exceeds the second reference speed continues for a specified distance or more or for a specified time or more, and to set the specified distance or the specified time longer as a number of times the speed of the vehicle exceeds the second reference speed from the time point at which the speed of the vehicle falls below the first reference speed, increases.

* * * * *